US006288340B1

(12) United States Patent
Arnould

(10) Patent No.: US 6,288,340 B1
(45) Date of Patent: Sep. 11, 2001

(54) CABLE FOR TRANSMITTING INFORMATION AND METHOD OF MANUFACTURING IT

(75) Inventor: Daniel Arnould, Fumay (FR)

(73) Assignee: Nexans, Paris (FR)

( * ) Notice: Subject to any disclaimer, the term of this patent is extended or adjusted under 35 U.S.C. 154(b) by 0 days.

(21) Appl. No.: 09/329,194

(22) Filed: Jun. 10, 1999

(30) Foreign Application Priority Data

Jun. 11, 1998 (FR) ..... 98 07342

(51) Int. Cl.[7] ..... H01B 11/02
(52) U.S. Cl. ..... 174/113 R
(58) Field of Search ..... 174/113 R, 113 C, 174/131 A, 36

(56) References Cited

U.S. PATENT DOCUMENTS 1,389,143 * 8/1921 Kempton ..... 174/113 C
2,538,019 * 1/1951 Lee ..... 174/113 C X
3,911,200 * 10/1975 Simons et al. ..... 174/36
4,453,031 * 6/1984 Justiss ..... 174/36
5,789,711 * 8/1998 Gaeris et al. ..... 174/113 C
5,969,295 * 10/1999 Boucino et al. ..... 174/113 C

FOREIGN PATENT DOCUMENTS 0 529 607 A1 3/1993 (EP) .
2 120 836 A 12/1983 (GB) .

* cited by examiner

*Primary Examiner*—Chau N. Nguyen
(74) *Attorney, Agent, or Firm*—Sughrue, Mion, Zinn, Macpeak & Seas, PLLC

(57) ABSTRACT

A cable for transmitting information includes a set of conductors or pairs or quads of conductors insulated from each other to limit crosstalk between the conductors, pairs or quads and at least two metalized longitudinal flexible tapes separating the conductors, pairs or quads. The tapes are applied around each conductor, pair or quad by virtue of twisting or torsion of the cable. The tape is preferably folded so that each pair is shielded by a double thickness of tape.

4 Claims, 8 Drawing Sheets

CABLE FOR TRANSMITTING INFORMATION AND METHOD OF MANUFACTURING IT

BACKGROUND OF THE INVENTION

1. Field of the Invention

The invention concerns an electrical conductor cable for transmitting information. It also concerns a method of manufacturing a cable of this kind.

2. Description of the Prior Art

Nowadays information is transmitted via electrical cables comprising a large number of conductors and at very high frequencies. The increased frequencies and the increased number of streams of information to be transmitted in parallel on separate conductors leads to the necessity of providing effective insulation between the various electrical conductors assembled together in the same cable. The risk of crosstalk increases with the number of conductors and the frequency. Crosstalk is the result of information transmitted on one conductor being radiated toward another conductor.

The information is usually transmitted by pairs of conductors and the pairs are insulated and/or shielded from each other to prevent crosstalk, or near-end crosstalk.

The most usual solution to the problem of shielding each pair of conductors is to wrap a metal or metalized tape around each pair in a helix, the cable being formed by assembling the shielded pairs into a common protective sheath. Shielding the pairs individually is slow and difficult. To connect the resulting cable the individual shields of the pairs must be removed to obtain access to the conductors, which makes the connection operation, which is usually carried out on site, difficult.

To overcome these drawbacks, document FR-2 738 947 proposes a cable in which the electrical shields of the various conductors, in particular the pairs, comprise a central member with radial fins separating the pairs from each other and partially shielding each pair and a peripheral shield around the central member and the pairs, the peripheral shield completing the shielding of each pair. However, the fins of the central member form stiffener ribs and a cable made this way is unsuitable for many applications in which the cable needs to be flexible. Also, a cable equipped with a central member of the above kind is not easy to manufacture as it necessitates an extrusion operation.

The invention provides a flexible cable having good insulation between conductors, pairs or quads and which is also particularly simple to manufacture and use.

SUMMARY OF THE INVENTION

To this end, the present invention proposes a cable for transmitting information including a set of conductors or pairs or quads of conductors insulated from each other to limit crosstalk between the conductors, pairs or quads and at least two metalized longitudinal flexible tapes separating the conductors, pairs or quads and applied around each conductor, pair or quad by virtue of twisting or torsion of the cable.

It has been found that the longitudinal tapes largely wrap around each pair by virtue of twisting or torsion of the cable and the shielding obtained is therefore more effective than simple compartmentalization.

Also, the cable is more flexible than with cruciform compartmentalization and simpler and faster to manufacture.

In the case of a non-twisted cable, the torsion necessary for the tapes to wrap around each pair can be small. It can also be obtained in a virtually natural fashion by winding the cable onto a spool, or unwinding it therefrom, during manufacture.

The tapes are preferably folded so that each conductor, pair or quad is shielded by a double thickness of tape.

In one embodiment of the invention, each tape is folded along a longitudinal line, the two sections on respective opposite sides of the longitudinal fold are pressed together and each is extended by an end section comprising the longitudinal edges of the tape, which end sections are pressed against the corresponding end sections of the other tape.

In this way, the center sections of the two tapes and the end sections of a tape pressed against the corresponding end sections of the other tape form four flexible walls and therefore delimit four compartments into which the conductors, pairs or quads are inserted. Each of the flexible walls wraps around the conductor, pair or quad by virtue of twisting or torsion of the cable.

The longitudinal folding line can be central, so that the four longitudinal sections of each tape have the same length, or offset relative to a central folding line, so that the four longitudinal sections of each tape have different widths.

The invention applies to a cable having any number of conductors, pairs or quads insulated from each other.

In one embodiment, at least one of the two tapes, or each tape, can be formed of a composite material comprising an insulative support onto which a metal is deposited. The composite tape is made of "Aluster", for example, i.e. polyester insulation covered with aluminum.

The tapes can be shaped at the same time as the conductors, pairs or quads are laid in the resulting compartments, laying obviously being effected downstream of shaping.

Other features and advantages of the invention will become apparent from the following description of particular embodiments of the invention given with reference to the accompanying drawings.

DETAILED DESCRIPTION OF THE PREFERRED EMBODIMENTS

Figure 1:
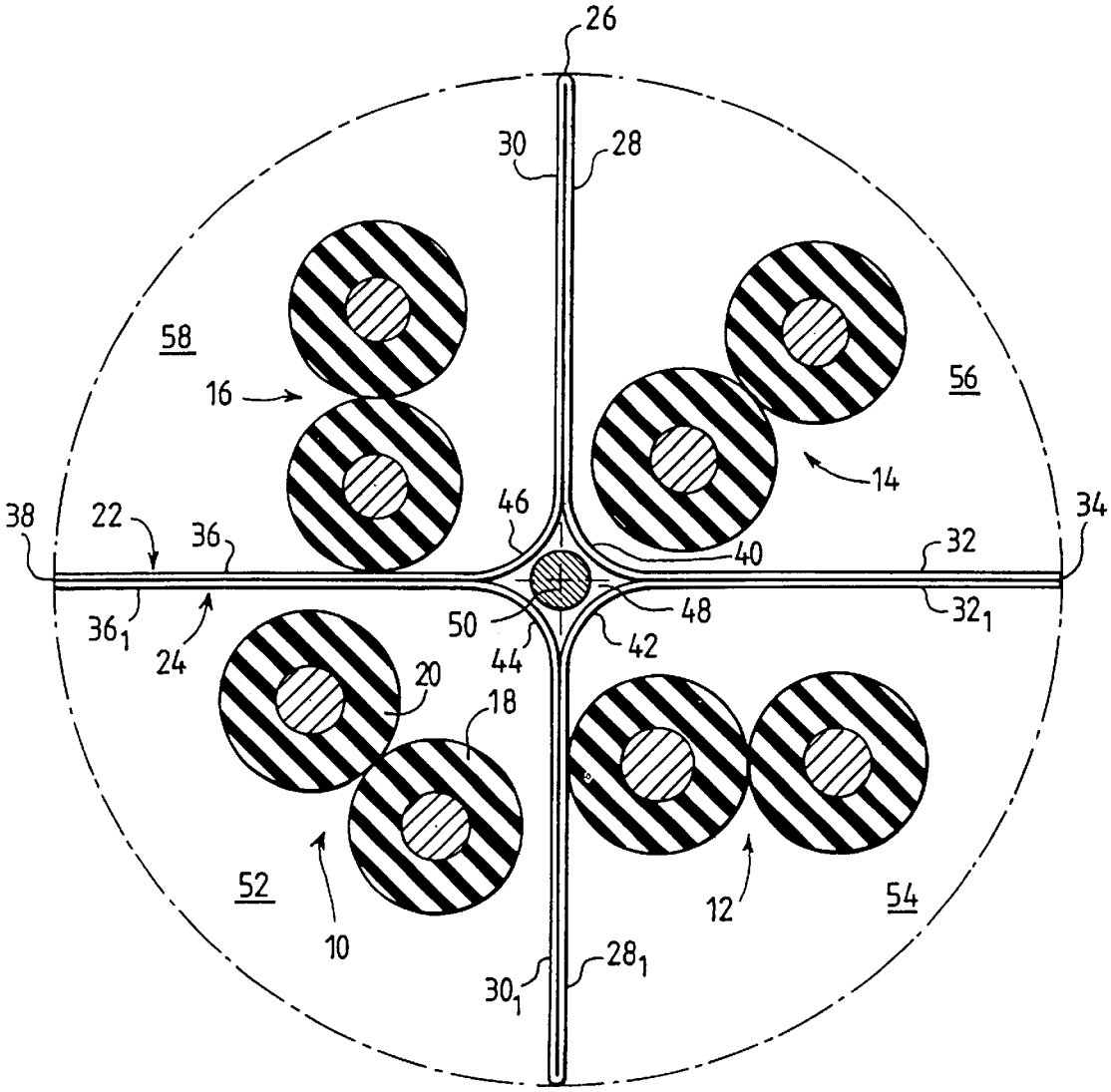
FIG. 1 is a diagram showing a first embodiment of a cable in accordance with the invention in section before it is finished by twisting it.
Figure 2:
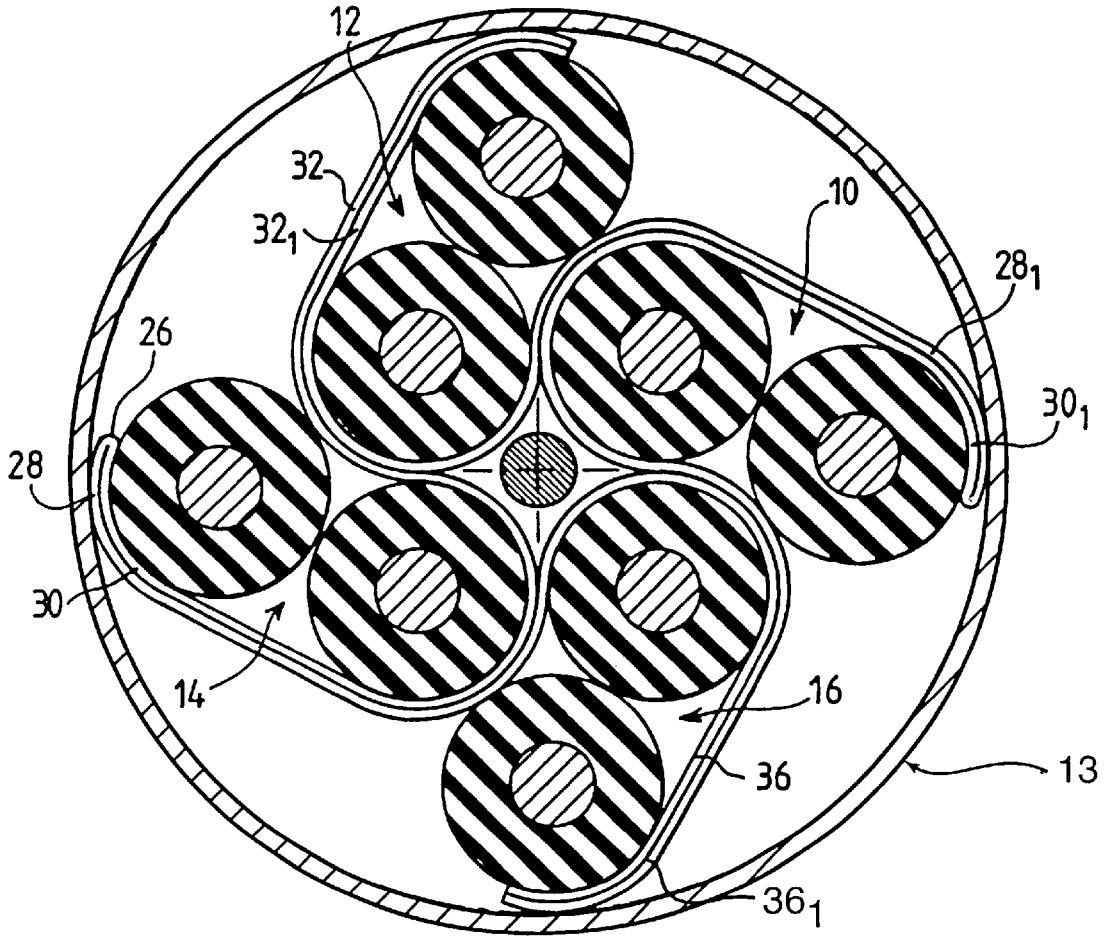
FIG. 2 is a view analogous to that of FIG. 1 after the cable is twisted.

In the example shown in FIGS. 1 and 2 the cable includes four pairs of twisted wires 10, 12, 14, 16. Each pair conventionally comprises two insulated wires 18, 20 (for the pair 10), each wire comprising a central conductor and an insulative sheath. The two wires 18 and 20 are twisted together.

Two "Aluster" composite tapes 22 and 24 are provided to shield the pairs from each other, that is to say to prevent near-end crosstalk, which consists in transmission of signals from one pair to another by induction. An Aluster tape comprises an aluminum film applied to a polyester film. In the remainder of the description a tape of this kind will be generally referred to as a composite tape.

Figure 9:
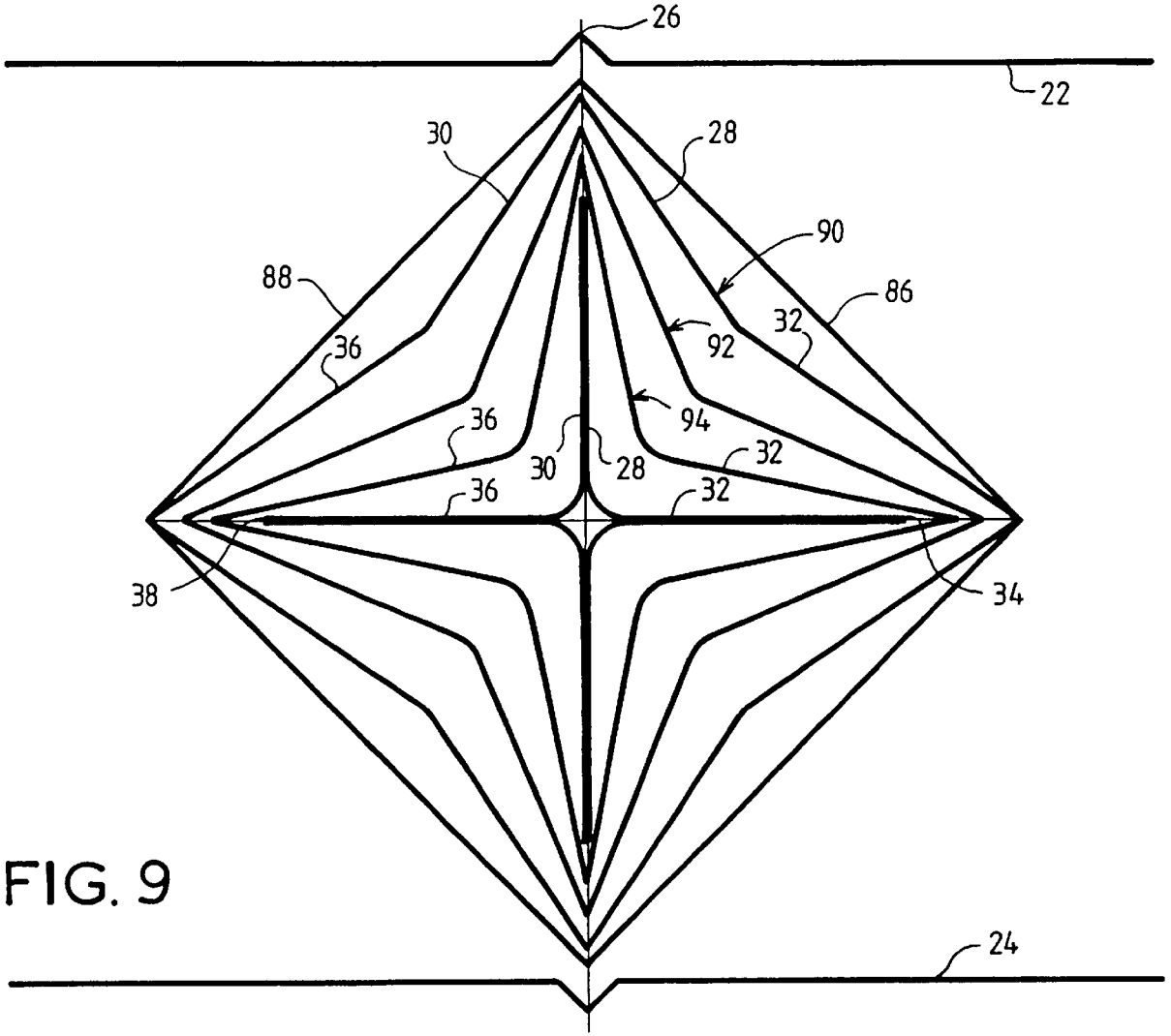
FIG. 9 shows the steps of forming tapes of a cable in accordance with the invention in the installation shown in FIGS. 7 and 8.

During its manufacture, each tape 22, 24 is folded so that it has four sections separated by longitudinal folds (see FIGS. 1 and 9).

The four sections are the same width. Thus the tape 22 has a central fold 26 on respective opposite sides of which are two sections 28 and 30 of equal width pressed together. The section 28 is extended by a section 32 at right angles which ends at a longitudinal edge 34. Similarly, the section 30 is extended in the opposite direction by a second end section 36 terminating at a second longitudinal edge 38.

In the same way, the tape 24 is folded with two central sections 281 and $\mathbf{30}_1$ pressed against each other and two end sections $\mathbf{32}_1$ and $\mathbf{36}_1$. The sections 32 and $\mathbf{32}_1$ are pressed against each other. Similarly, the section 36 is pressed against the section $\mathbf{36}_1$. In this way, seen in cross section, the two tapes form a cross with four branches of equal length. The first branch is formed by the sections 28 and 30, the second by the sections 32 and $\mathbf{32}_1$, the third by the sections $\mathbf{28}_1$ and $\mathbf{30}_1$ and the fourth by the sections 36 and $\mathbf{36}_1$.

The sections at right angles, such as the sections 28 and 32, are joined by a curved part 40. The combination of the curved parts 40, 42, 44, 46 forms a space 48 whose section is the shape of a curvilinear quadrilateral. The space 48 is filled by a bare conductive wire 50 constituting a continuity wire whose function is to facilitate connecting the cable at its ends and to assure electrical continuity if the tape is interrupted because of deterioration or an accident.

The four branches mentioned above delimit four compartments 52, 54, 56 and 58 each of which receives a respective twisted pair 10, 12, 14 and 16.

The cable as a whole is twisted after forming the compartments and installing the twisted pairs in the respective compartments. Each flexible wall, which consists of two central sections of the same tape or two end sections of two different tapes, therefore wraps around one pair and is pressed against that pair.

Accordingly, FIG. 2 shows the two tape sections 28, 30 pressed together and wrapped around the twisted pair 14; similarly, the sections 32 and $\mathbf{32}_1$ wrap around the pair 12, the sections $\mathbf{28}_1$ and $\mathbf{30}_1$ wrap around the pair 10 and the sections 36 and $\mathbf{36}_1$ wrap around the pair 16.

The resulting assembly is then conventionally surrounded by an outer shield 13 and insulation.

Inside the cable the pairs are separated from each other by a shield which prevents any propagation of waves emitted by one pair toward another pair, which minimizes near-end crosstalk.

It is not indispensable for the cable to be twisted for the tape sections to be pressed against the pairs. A different type of torsion can be used.

In one embodiment, in which the cable has an overall diameter of approximately 5.65 mm, the conductor of each wire has a diameter 0.53 mm, each wire has an outside (insulation) diameter of 1.42 mm, the continuity wire has a diameter of 0.45 mm and the tapes are composite tapes with a 50 $\mu$m thick aluminum layer and a 12 $\mu$m thick polyester layer, the cable can be used at frequencies up to 600 MHz with limited crosstalk between pairs.

In this example the aluminum layer of each tape faces inward, i.e. the aluminum layers of the sections 28 and 30 are pressed together, and similarly the aluminum layers of the sections 32 and $\mathbf{32}_1$ and 36 and $\mathbf{36}_1$ are pressed together.

It is therefore unnecessary to provide any lubricant where the tape passes over the guide and forming rollers during manufacture because the polyester in contact with the rollers has sliding qualities significantly better than those of aluminum.

Figure 3:
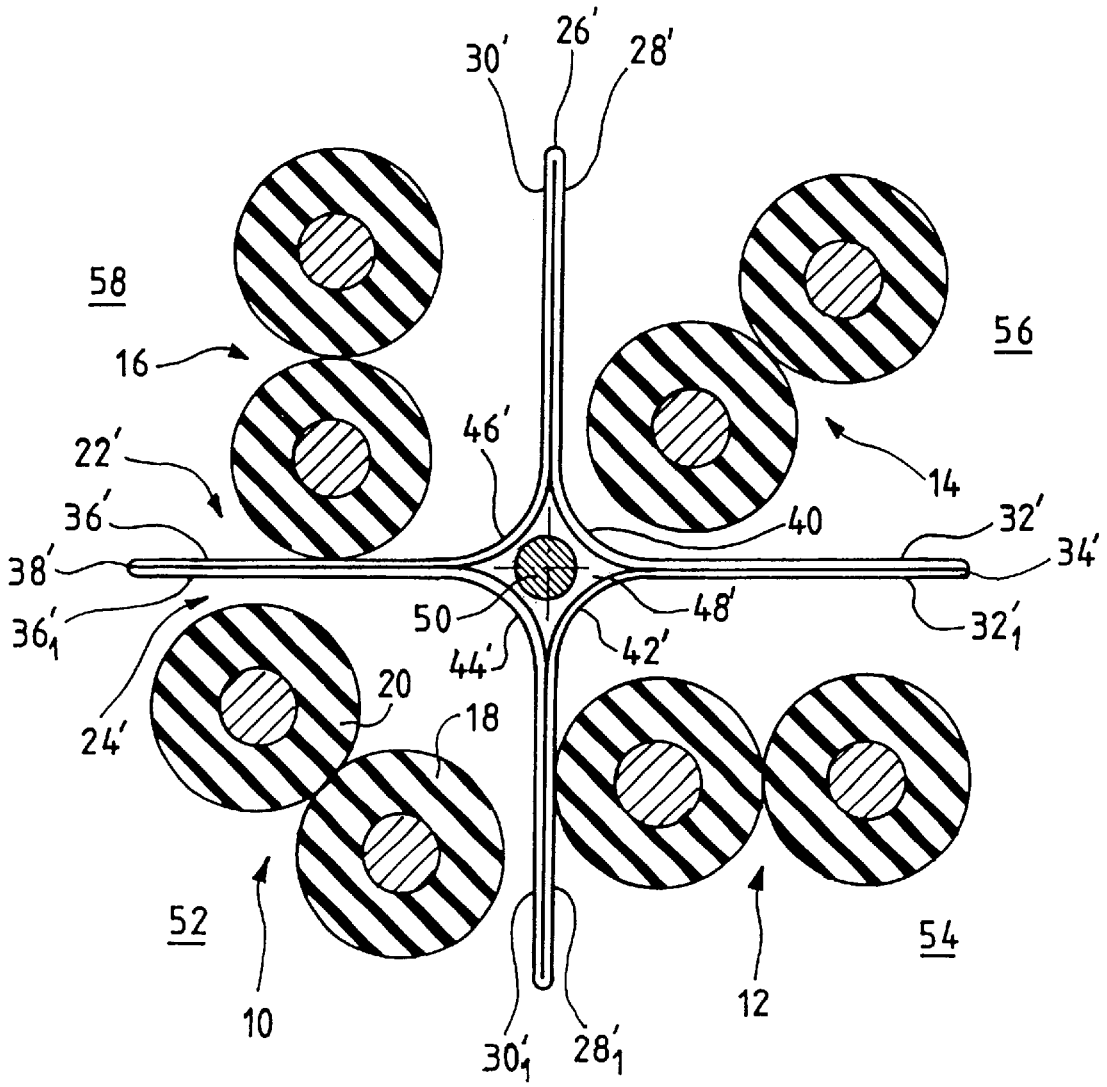
FIG. 3 is a diagram showing a second embodiment of a cable in accordance with the invention in section before it is finished by twisting it.
Figure 4:
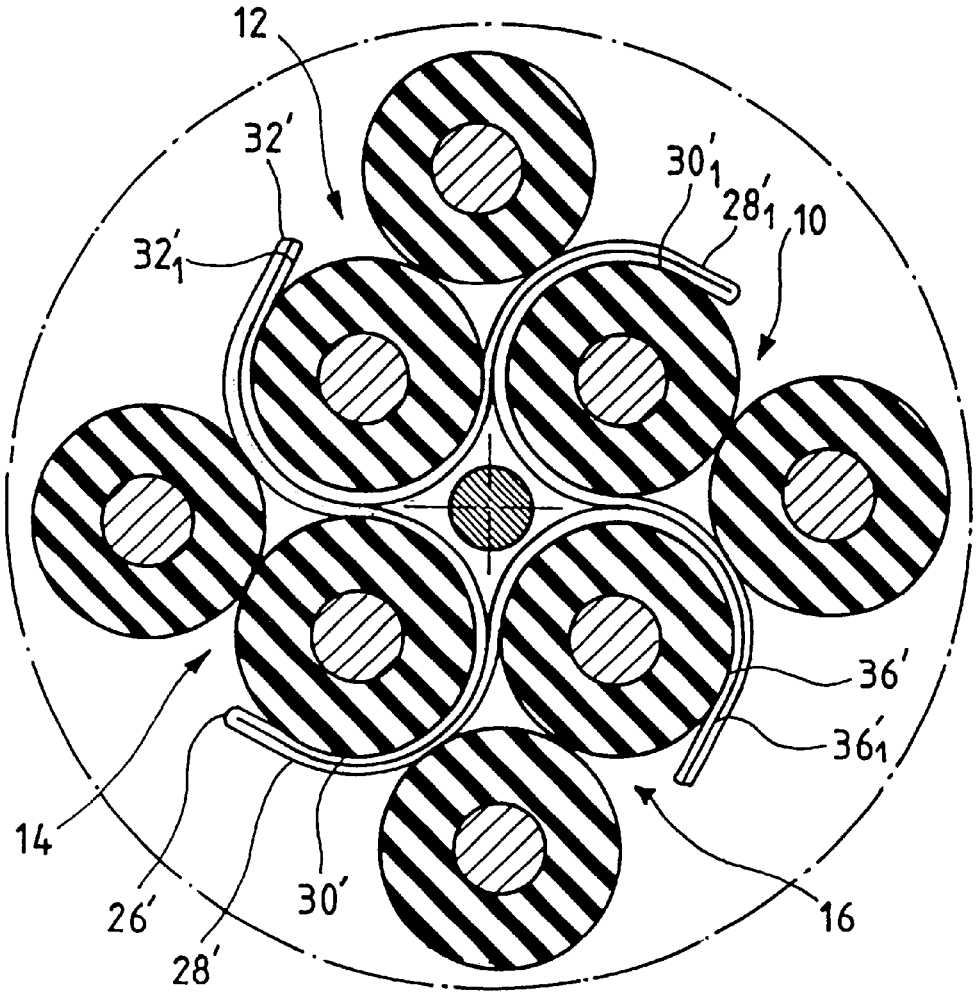
FIG. 4 is a view analogous to that of FIG. 3 after the cable is twisted.

In FIGS. 3 and 4, all the reference numbers concerning the tapes are identical to those from FIGS. 1 and 2 except they are "primed".

The example shown in FIGS. 3 and 4 is identical to that shown in FIGS. 1 and 2 except that the tapes 22' and 24', corresponding to the tapes 22 and 24 shown in FIGS. 1 and 2, are shorter than the latter. The resulting cable has the same advantages as that shown in FIGS. 1 and 2. In particular, good protection against near-end crosstalk is also obtained in this case.

Figure 5:
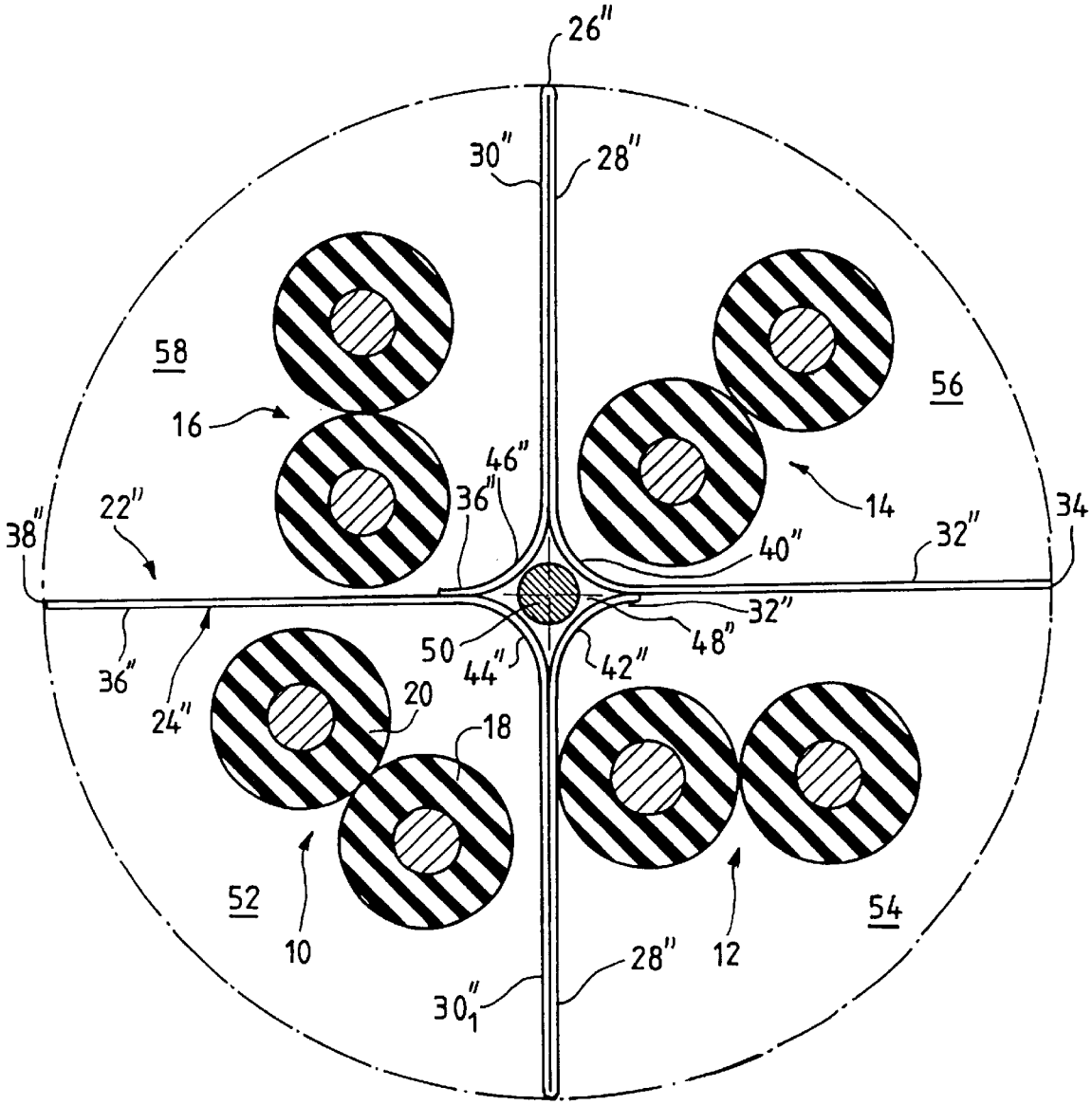
FIG. 5 is a diagram showing a third embodiment of a cable in accordance with the invention in section before it is finished by twisting it.
Figure 6:
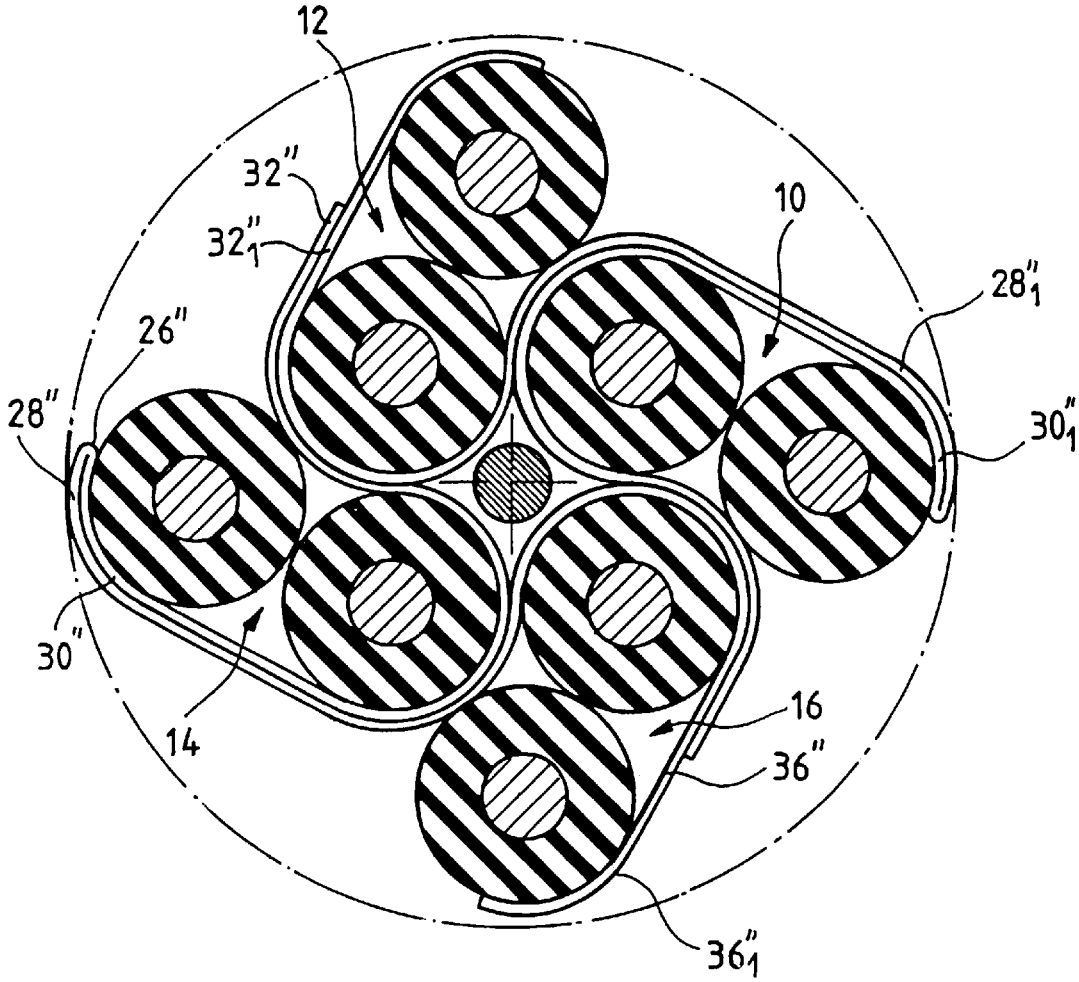
FIG. 6 is a view analogous to that of FIG. 5 after the cable is twisted.

In FIGS. 5 and 6, all the reference numbers concerning the tapes are identical to those from FIGS. 1 and 2 except they are "double-primed".

The example shown in FIGS. 5 and 6 is identical to that shown in FIGS. 1 and 2 except that the tapes 22' and 24', corresponding to the tapes 22 and 24 shown in FIGS. 1 and 2, are shorter than the latter and folded asymmetrically (for which purpose they are offset relative to each other during manufacture). The resulting cable has the same advantages as that shown in FIGS. 1 and 2. In particular, good protection against near-end crosstalk is also obtained in this case.

The invention is not limited to a cable made up of pairs. The flexible tapes could be used to provide shielding between single conductors or quads or other combinations of conductors.

Figure 7:
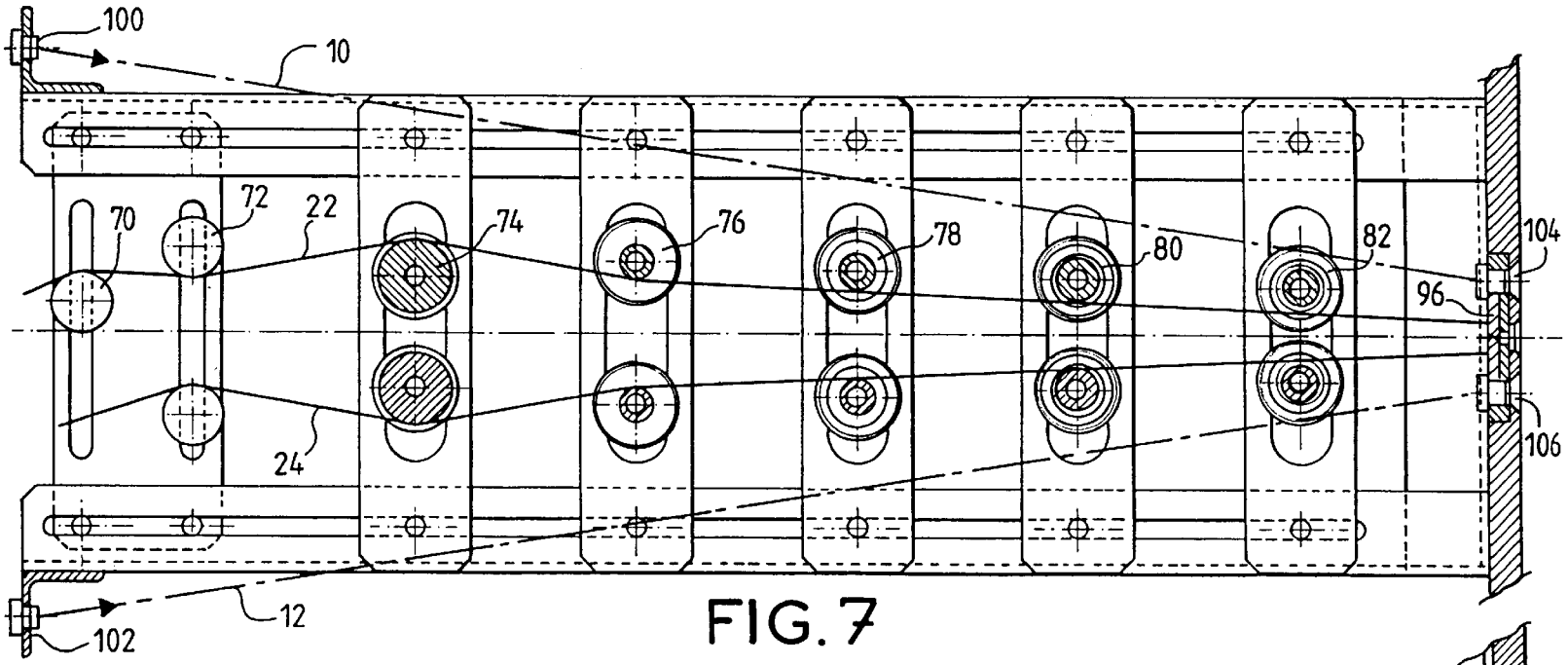
FIG. 7 is a side view of part of an installation for manufacturing a cable in accordance with the invention.
Figure 8:
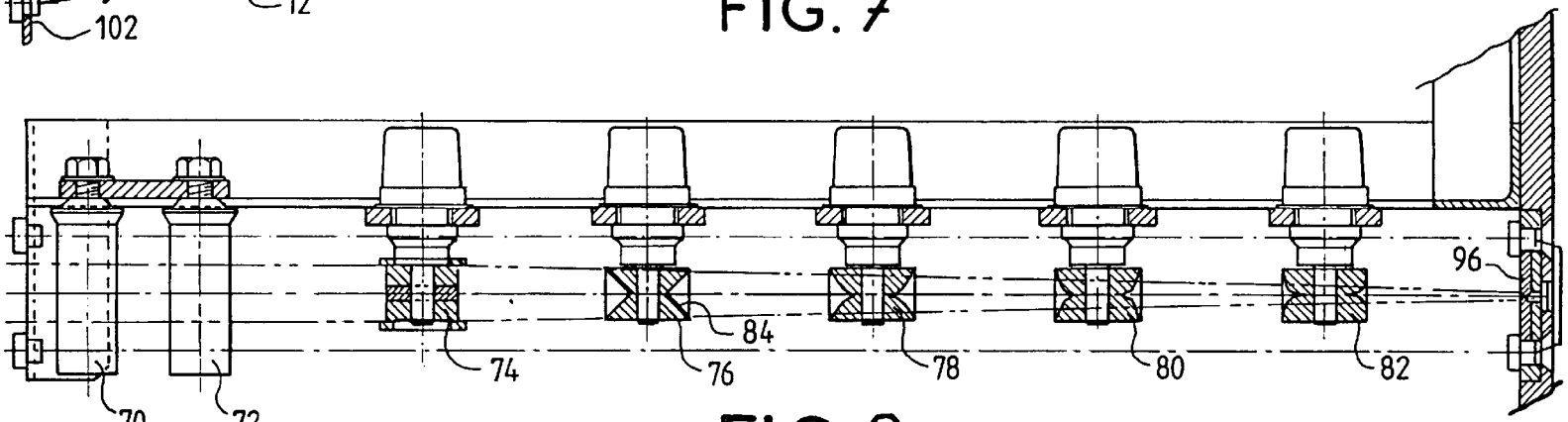
FIG. 8 is a plan view in section taken along the axes of the rollers of the installation from FIG. 7.

The manufacturing installation for cables in accordance with the invention shown in FIGS. 7 and 8 includes guide rollers whose periphery is shaped to fold and form the tapes. Thus, for the tape 22, there are two guide rollers 70, 72, a roller 74 to form the central fold 26 and a series of successive rollers 76, 78, 80 and 82 for progressively forming the sections 28, 30, 32 and 36. FIG. 4 shows that the roller 76 has at its periphery 84 a concave V-shape that forms the tape with two equal sections 86 and 88 (FIG. 9).

The periphery of the roller 78 begins to separate each longitudinal half-tape 86, 88 into two parts that will form the respective sections 30, 36 and 28, 32. The folding effected by the roller 78 is shown at 90 in FIG. 9.

The rollers 80 and 82 complete the shaping and folding. The folding at the exit from the roller 80 is shown at 92 in FIG. 9 and the folding effected by the roller 82 is shown by the part 94.

A die 96 downstream of the roller 96 completes the folding of the tape.

Guide means 100, 102, 104, 106 are also provided for the twisted pairs 10, 12, etc. The guide means position the pairs in the compartments 52, 54, 56, 58 on the output side of the die 96 (see FIG. 1). The cable as a whole is twisted downstream of the die 96.

The installation shown in FIGS. 7 and 8 is used to manufacture the second and third embodiments of cables in accordance with the invention. FIG. 9 shows in particular the situation in which the tapes are folded symmetrically but can be adapted directly to the situation in which the tapes are folded asymmetrically, as shown in FIGS. 5 and 6.

Installing the tapes does not slow down the manufacture of the cable because they are installed at the same time as the twisted pairs. The speed with which the cable is manufactured is therefore higher than that of a cable with extruded cruciform compartmentalization, like the cable described in the previously mentioned document FR-2 738 947.

The invention also concerns a method of manufacturing a cable in which the two tapes 22, 24 are folded and assembled to form a cross with four branches delimiting four quadrants 52, 54, 56, 58, a conductor, pair or quad is installed in each quadrant after this shaping and assembly, and torsion is then applied to the assembly, for example by twisting the assembly.

This method applies equally to the embodiments shown in FIGS. 3 to 6.

What is claimed is:

1. A cable for transmitting information, including a set of conductors or pairs or quads of conductors insulated from each other to limit crosstalk between said conductors, pairs or quads, and at least two metalized longitudinal flexible tapes separating said conductors, pairs or quads and applied around said conductors pairs or quads by virtue of twisting or torsion of said cable; and wherein each of said at least two tapes is folded along a longitudinal folding line to form a folded branch by pressing together respective opposite sections of the longitudinal folding line;

wherein each of said at least two tapes comprises two longitudinal end sections, including respective longitudinal edges of each tape, extending away from said folded branch; and wherein each end section of each of said at least two tapes is pressed against a corresponding end section of the other of said at least two tapes to form a pressed branch.

2. The cable claimed in claim 1, wherein said longitudinal folding line for each tape is centered with respect to the tape and wherein each of said opposite sections of said folded branches and said end sections of said pressed branches has a same width.

3. The cable claimed in claim 1, wherein said longitudinal folding line for each tape is offset relative to a longitudinal center line of said tape, and wherein for each tape, one of the two end sections of the tape has a different width than the other end section of the tape.

4. The cable claimed in claim 1, wherein a space extending longitudinally along said cable is formed at an intersection of said folded branches and said pressed branches, and wherein said cable further comprises a conductive continuity wire extending longitudinally within said space.

* * * * *